US010504679B2

(12) United States Patent
Ohashi

(10) Patent No.: US 10,504,679 B2
(45) Date of Patent: Dec. 10, 2019

(54) X-RAY GENERATING APPARATUS AND RADIOGRAPHY SYSTEM INCLUDING THE SAME

(71) Applicant: CANON KABUSHIKI KAISHA, Tokyo (JP)

(72) Inventor: Yasuo Ohashi, Hadano (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 174 days.

(21) Appl. No.: 15/739,965

(22) PCT Filed: Jun. 29, 2016

(86) PCT No.: PCT/JP2016/003118
§ 371 (c)(1),
(2) Date: Dec. 26, 2017

(87) PCT Pub. No.: WO2017/002363
PCT Pub. Date: Jan. 5, 2017

(65) Prior Publication Data

US 2018/0182590 A1 Jun. 28, 2018

(30) Foreign Application Priority Data

Jul. 2, 2015 (JP) ..... 2015-133619

(51) Int. Cl.
*H01J 35/08* (2006.01)
*H05G 1/06* (2006.01)

(52) U.S. Cl.
CPC ..... *H01J 35/08* (2013.01); *H05G 1/06* (2013.01); *H01J 35/116* (2019.05); *H01J 2235/083* (2013.01)

(58) Field of Classification Search
CPC .... H01J 35/08; H01J 35/116; H01J 2235/083; H05G 1/06
(Continued)

(56) References Cited

U.S. PATENT DOCUMENTS 4,646,338 A * 2/1987 Skillicorn ..... H01J 35/04 378/110
2005/0141669 A1 6/2005 Shimono
(Continued)

FOREIGN PATENT DOCUMENTS

CN 1306552 C 3/2007
CN 102237242 A 11/2011
(Continued)

*Primary Examiner* — Courtney D Thomas
(74) *Attorney, Agent, or Firm* — Canon USA, Inc., IP Division

(57) ABSTRACT

Provided is an X-ray generating apparatus in which a likelihood that an anode member may be deformed by heat deformation of a container is eliminated or reduced to maintain a positional relationship between an electron source and a transmission target within a predetermined range, and stable output of X-rays is achieved. The X-ray generating apparatus includes an X-ray generating tube and the container that accommodates the X-ray generating tube. The X-ray generating tube includes an anode that includes the transmission target and an anode member holding the transmission target. The anode member is sandwiched together with a deformable member between the container and a retaining member secured to the container, thus connecting the X-ray generating tube to the container.

12 Claims, 6 Drawing Sheets

(58) Field of Classification Search
USPC ..... 378/121, 140
See application file for complete search history.

(56) References Cited

U.S. PATENT DOCUMENTS

| | | | |
|---|---|---|---|
| 2005/0207537 | A1 | 9/2005 | Ukita |
| 2014/0037055 | A1 | 2/2014 | Ogura |

FOREIGN PATENT DOCUMENTS

| | | | |
|---|---|---|---|
| CN | 103943442 | A | 7/2014 |
| CN | 103975232 | A | 8/2014 |
| JP | 07-253499 | A | 10/1995 |
| JP | H0-106463 | A | 4/1998 |
| JP | 2004-265602 | A | 9/2004 |
| JP | 2012-124098 | A | 6/2012 |
| JP | 2016-539484 | A | 12/2016 |
| WO | 2012/140860 | A1 | 10/2012 |

* cited by examiner

[Fig. 1]
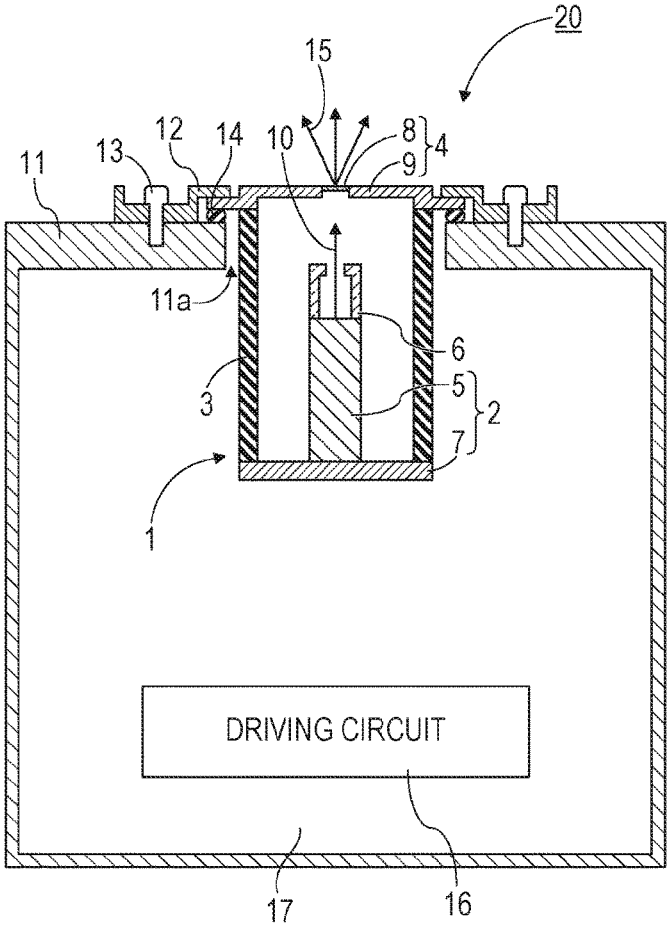

[Fig. 2A]
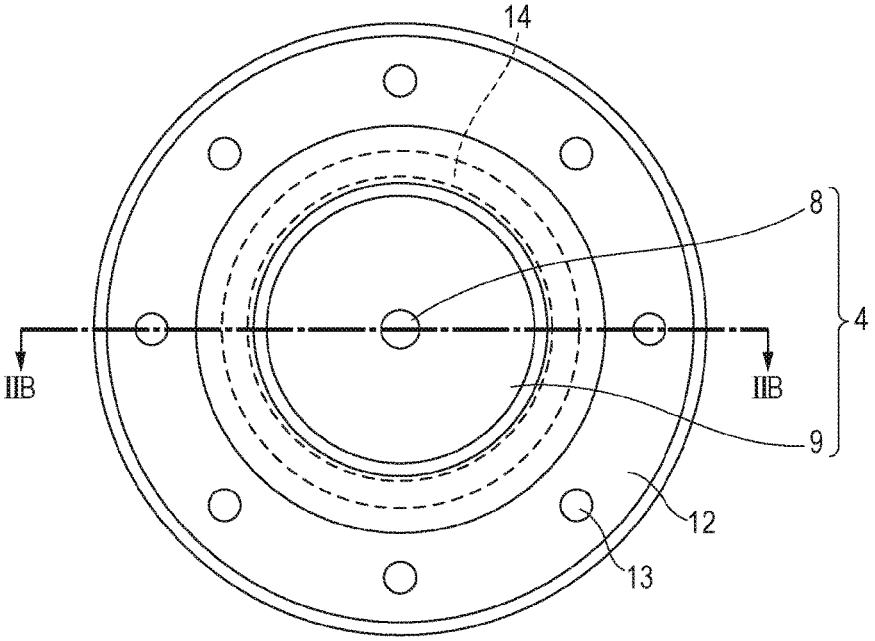
[Fig. 2B]
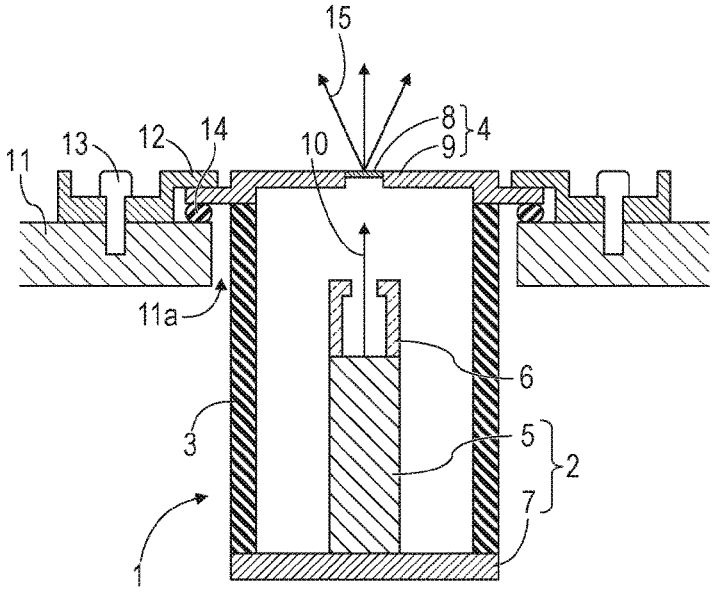

[Fig. 3A]
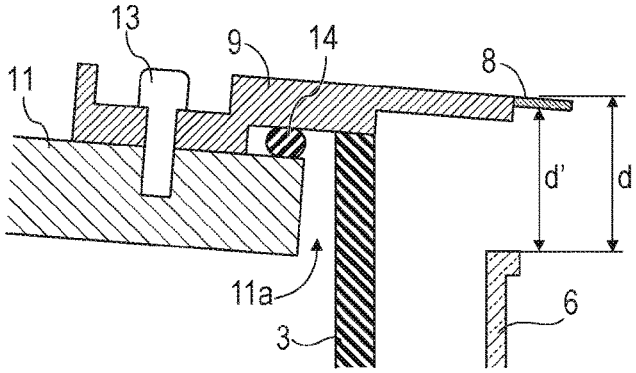
[Fig. 3B]
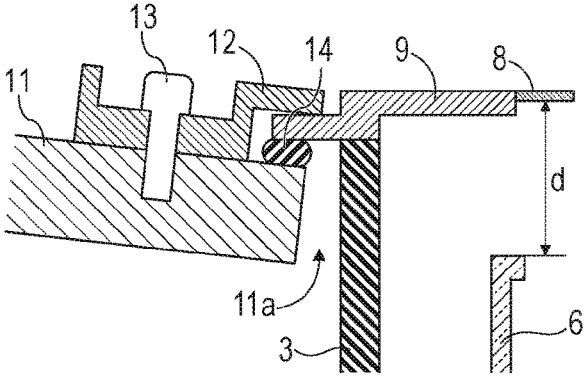

[Fig. 4A]
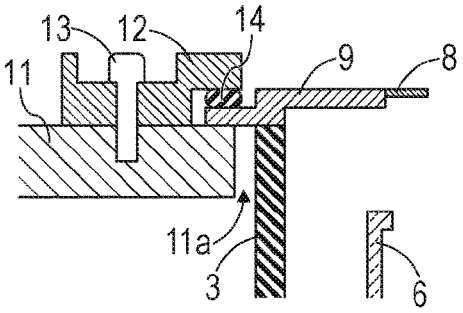
[Fig. 4B]
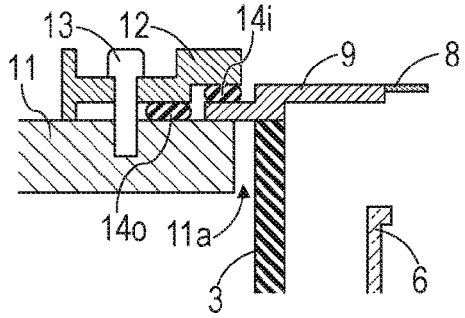
[Fig. 4C]
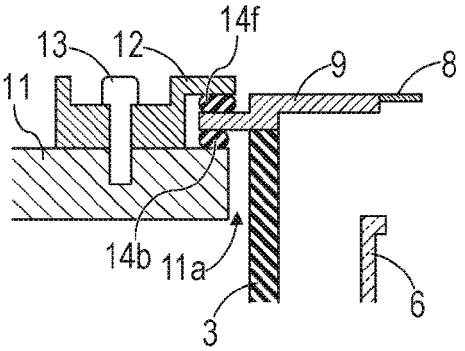

[Fig. 4D]
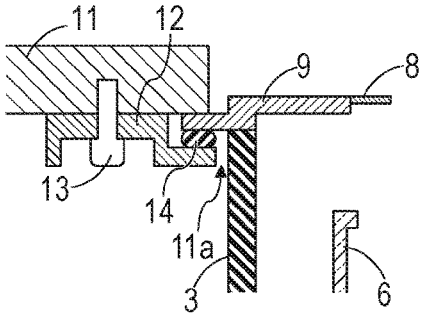
[Fig. 4E]
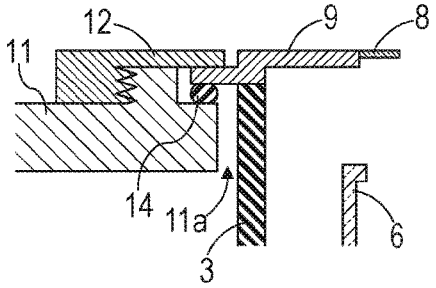

[Fig. 5]
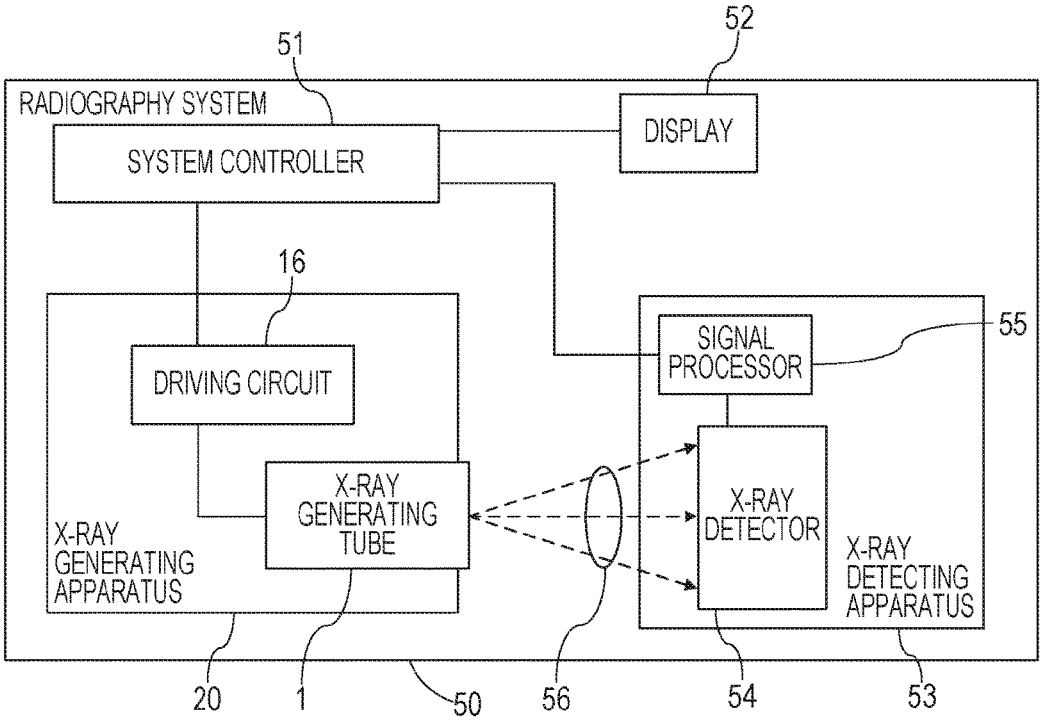

X-RAY GENERATING APPARATUS AND RADIOGRAPHY SYSTEM INCLUDING THE SAME

TECHNICAL FIELD

The present invention relates to a radiography system that is applicable to, for example, medical equipment and a nondestructive inspection apparatus, and an X-ray generating apparatus included in the system.

BACKGROUND ART

An X-ray generating tube includes an insulating tube, a cathode attached to one opening of the insulating tube, and an anode attached to the other opening of the insulating tube so as to form a vacuum container. The cathode is connected to an electron source. The anode includes a target. In the X-ray generating tube, a tube voltage is applied between the cathode and the anode to cause the electron source to emit an electron beam, and the emitted electron beam collides with the target, thus generating X-ray's.

PTL 1 discloses an X-ray generating apparatus including a transmission X-ray generating tube including a transmission target and a container accommodating the X-ray generating tube. In the X-ray generating tube described in PTL 1, an anode member is secured to the container by screws, thereby grounding the anode through the container.

CITATION LIST

Patent Literature

PTL 1: Japanese Patent Laid-Open No. 2004-265602

SUMMARY OF INVENTION

As disclosed in PTL 1, the anode member holding the target is secured to the container in the X-ray generating apparatus. In such a configuration, the quality of an X-ray beam may vary depending on driving history of the X-ray generating apparatus, affecting the quality of a captured image. Variations of the X-ray beam quality include a variation in focal spot shape and a variation in focal spot size. To improve the reliability of the X-ray generating apparatus, such variations need to be eliminated or reduced.

A typical X-ray generating apparatus includes a container, an X-ray generating tube, whose power efficiency is not always high, a tube voltage circuit for applying a tube voltage to the X-ray generating tube, and a driving circuit for controlling an electron source. The container accommodates the X-ray generating tube and the circuits. The container may be deformed by heat generated from, for example, the X-ray generating tube, the tube voltage circuit, and the driving circuit.

There is a demand for an X-ray generating apparatus in which the quality of a generated X-ray beam is hardly likely to vary due to heat deformation of a container.

The present invention provides a highly reliable X-ray generating apparatus in which a likelihood that an anode member may be deformed by heat deformation of a container is eliminated or reduced and a change in X-ray quality associated with driving is eliminated or reduced. The present invention further provides a highly reliable radiography system that includes the X-ray generating apparatus and in which a variation in imaging quality is eliminated or reduced.

The present invention provides an X-ray generating apparatus including an X-ray generating tube and a container that accommodates the X-ray generating tube. The X-ray generating tube includes an anode that includes a transmission target configured to generate X-rays and an anode member holding the transmission target. The anode member is sandwiched together with a deformable member between the container and a retaining member secured to the container, thus connecting the X-ray generating tube to the container.

The present invention further provides a radiography system including the X-ray generating apparatus, an X-ray detecting apparatus configured to detect X-rays emitted from the X-ray generating apparatus and penetrated through an object, and a system controller configured to control the X-ray generating apparatus and the X-ray detecting apparatus such that these apparatuses work in collaboration with each other.

Further features of the present invention will become apparent from the following description of exemplary embodiments with reference to the attached drawings.

Advantageous Effects of Invention

According to the present invention, in the X-ray generating apparatus configured such that the anode member of the X-ray generating tube is attached to the container, deformation of the container is absorbed by the deformable member sandwiched together with the anode member between the container and the retaining member, thus eliminating or reducing deformation of the anode member. This eliminates or reduces a variation in the distance between an electron source and the target caused by deformation of the anode member resulting from deformation of the container. According to the present invention, the X-ray generating apparatus enables stable X-ray emission and exhibits high reliability. In addition, a shift in the position of an X-ray focal spot is eliminated or reduced in an X-ray detector for detecting X-rays emitted from the X-ray generating apparatus according to the present invention. The use of the X-ray generating apparatus according to the present invention, therefore, eliminates or reduces a variation in image quality. Thus, the radiography system including the X-ray generating apparatus according to the present invention exhibits high reliability.

BRIEF DESCRIPTION OF DRAWINGS

FIG. 1 schematically illustrates an exemplary configuration of an X-ray generating apparatus according to an embodiment of the present invention, and is an axial sectional view illustrating an insulating tube of an X-ray generating tube.

FIG. 2A schematically illustrates the X-ray generating tube of the X-ray generating apparatus of FIG. 1 and its surroundings, and is a plan view illustrating an anode of the X-ray generating tube when viewed from the outside of the apparatus.

FIG. 2B schematically illustrates the X-ray generating tube of the X-ray generating apparatus of FIG. 1 and its surroundings, and is an axial sectional view illustrating the insulating tube of the X-ray generating tube.

FIG. 3A is a schematic sectional view of a configuration without features of the present invention, and explains effects of deformation of a container in the X-ray generating apparatus on an anode member.

FIG. 3B is a schematic sectional view of a configuration in the embodiment, and explains the effects of deformation of the container in the X-ray generating apparatus on the anode member.

FIG. 4A is a sectional view of a modification of the X-ray generating apparatus according to the embodiment, and illustrates connection between the anode member and the container.

FIG. 4B is a sectional view of another modification of the X-ray generating apparatus according to the embodiment, and illustrates connection between the anode member and the container.

FIG. 4C is a sectional view of further another modification of the X-ray generating apparatus according to the embodiment, and illustrates connection between the anode member and the container.

FIG. 4D is a sectional view of still another modification of the X-ray generating apparatus according to the embodiment, and illustrates connection between the anode member and the container.

FIG. 4E is a sectional view of further another modification of the X-ray generating apparatus according to the embodiment, and illustrates connection between the anode member and the container.

FIG. 5 is a schematic diagram of an exemplary configuration of a radiography system according to an embodiment of the present invention.

DESCRIPTION OF EMBODIMENTS

Embodiments of the present invention will be described below with reference to the drawings, but the present invention is not limited to these embodiments. Note that known or well-known technology in the art is applied to a portion that is not particularly illustrated or described in this specification.

X-Ray Generating Apparatus

FIG. 1 schematically illustrates an exemplary configuration of an X-ray generating apparatus according to an embodiment of the present invention. FIG. 1 is an axial sectional view illustrating an X-ray generating tube 1.

An X-ray generating apparatus 20 according to the present embodiment of the invention includes a container 11 having an opening 11*a* and the X-ray generating tube 1 accommodated in the container 11. An inside space of the container 11 is filled with an insulating fluid 17. In this embodiment, the container 11 further accommodates a driving circuit 16, which is secured to the container 11 by a member (not illustrated). The driving circuit 16 is connected to the X-ray generating tube 1 by a wiring line (not illustrated). The driving circuit 16 may be disposed outside the container 11. The container 11 can be formed of metal, such as aluminum, brass, or 304 stainless steel (hereinafter, "SUS 304"). Examples of the insulating fluid 17 include insulating liquids, such as mineral oil and silicone oil, and an insulating gas, such as $SF_6$. In this apparatus, the X-ray generating tube 1 is inserted into the opening 11*a* of the container 11 and is connected to the container 11 to hermetically seal the container 11.

FIGS. 2A and 2B are enlarged views illustrating the X-ray generating tube 1 in FIG. 1 and its surroundings. FIG. 2A is a plan view illustrating an anode 4 of the X-ray generating tube 1 when viewed from the outside of the X-ray generating apparatus 20. FIG. 2B is an axial sectional view illustrating an insulating tube 3 taken along the line IIB-IIB in FIG. 2A.

The X-ray generating tube 1 in the embodiment includes the insulating tube 3, a cathode 2 joined to one opening of the insulating tube 3, and the anode 4 joined to the other opening of the insulating tube 3. The anode 4 includes a target 8 and an anode member 9 holding the target 8. The cathode 2 includes a cathode member 7 and an electron source 5.

The insulating tube 3 is formed of an insulating material, such as ceramic. Both the ends of the insulating tube 3 are hermetically joined to the anode member 9 and the cathode member 7. Since the anode member 9 and the cathode member 7 are joined to the insulating tube 3, the anode member 9 and the cathode member 7 can be formed of metal having a coefficient of thermal expansion close to that of the insulating tube 3, for example, Kovar or tungsten.

The electron source 5 is, for example, of an impregnation type, a filament type, a Schottky type, or a field emission type. The electron source 5 is connected to the cathode member 7. The electron source 5 and the cathode member 7 constitute the cathode 2. A tip of the electron source 5 is provided with an electron lens 6 for converging an electron beam 10 accelerated by an electric field. The electron beam 10 is converged to an intended electron beam size on the target 8.

The target 8, which is a transmission target, includes a target layer (not illustrated) that generates X-ray's in response to irradiation with electrons and further includes a support substrate (not illustrated) that supports the target layer and that is formed of a material allowing X-rays to penetrate. The target 8 is disposed such that the target layer faces the electron source 5. An outer end of the support substrate is held by the anode member 9. The support substrate of the target 8 can be formed of, for example, diamond or beryllium. The target layer serves as a member that generates X-rays in response to irradiation with an electron beam. The target layer contains a metal element having a high atomic number, a high melting point, and a high specific gravity as target metal. The target metal is selected from metal elements with an atomic number greater than or equal to 42. In terms of compatibility with the support substrate, the target metal can be selected from the group consisting of tantalum, molybdenum, and tungsten, which causes negative standard free energy on formation of carbide. The target layer may be formed of a single element or alloy of the above-described target metals, or may be formed of a compound, such as carbide, nitride, or oxynitride of the target metal.

As described above, the X-ray generating tube 1 is configured such that the insulating tube 3, the anode member 9, the cathode member 7, and the target 8 are hermetically joined to maintain vacuum (hermeticity) inside the X-ray generating tube 1. A proper voltage is applied between the cathode member 7 and the anode member 9 of the X-ray generating tube 1 to apply an intended voltage to the electron source 5 and the electron lens 6, so that the electron beam 10 is emitted from the electron source 5. The electron beam 10 collides with the target layer of the target 8, thus generating X-rays 15. The X-rays 15 penetrate the support substrate of the target 8 and are then emitted to the outside.

In the present invention, the anode member 9 is sandwiched together with a deformable member 14 between the container 11 and a retaining member 12, thus connecting the X-ray generating tube 1 to the container 11 at the opening 11*a* thereof. The deformable member 14 can be in contact with the anode member 9. Furthermore, there is an overlapped portion in any at least three of the anode member 9, the deformable member 14, the retaining member 12, and the container 11 in a radial direction of the insulating tube 3.

In the embodiment, the deformable member 14 is ring-shaped and is disposed such that the deformable member 14 continuously extends in a circumferential direction of the insulating tube 3. Although this form can be used to maintain the hermeticity of the container 11, the present invention is not limited to the form. For example, in an air-cooled X-ray generating apparatus configured such that the inside of the container 11 communicates with the outside thereof, or it is unnecessary to maintain the hermeticity of the container 11, the deformable member 14 may include a plurality of discrete segments and the segments may be arranged in the circumferential direction of the insulating tube 3.

In the embodiment, the container 11 and the retaining member 12 are firmly secured to each other, and the anode member 9 is merely in contact with the adjacent members (the retaining member 12 and the deformable member 14 in FIGS. 1 and 29). In addition, the deformable member 14 is merely in contact with the adjacent member, or the container 11 in FIGS. 1 and 2B. In the embodiment, the anode member 9 includes a ring-shaped flange extending to an opening in which the target 8 is fitted. The retaining member 12 is ring-shaped and is disposed such that the retaining member 12 continuously extends in the circumferential direction of the opening 11*a* of the container 11. As described above, the deformable member 14 continuously extends in the circumferential direction of the insulating tube 3. Consequently, a contact between the retaining member 12 and the anode member 9, a contact between the anode member 9 and the deformable member 14, and a contact between the deformable member 14 and the container 11 each have a ring shape, thus maintaining the hermeticity of the container 11. The present invention is not limited to this arrangement. In terms of maintaining the hermeticity of the container 11, at least one of the contact between the retaining member 12 and the anode member 9, the contact between the anode member 9 and the deformable member 14, and the contact between the deformable member 14 and the container 11 may have a ring shape.

Like the container 11, the retaining member 12 in the present invention can be formed of metal. Examples of the metal includes SUS 304 and an alloy of copper and tungsten.

In the X-ray generating apparatus 20 according to the embodiment, the deformable member 14 eliminates or reduces a likelihood that the anode member 9 may be deformed due to deformation of the container 11. The action of the deformable member 14 will now be described with reference to FIGS. 3A and 3B.

FIG. 3A is a sectional view illustrating a deformed state of the container 11 in a configuration without features of the present invention, namely, the container 11 to which the anode member 9 is directly secured by screws 13. FIG. 3B is a sectional view illustrating a deformed state of the container 11 in the embodiment.

After the X-ray generating apparatus 20 is driven, the driving circuit 16, the X-ray generating tube 1, and the target 8 generate heat, and the heat transmits through, for example, the insulating fluid 17 to increase the temperature of the X-ray generating apparatus 20, thus deforming the container 11. As illustrated in FIG. 3A, in the configuration in which the anode member 9 is directly secured to the container 11, the deformation of the container 11 causes the anode member 9 to be deformed, so that a distance d between the electron lens 6 and the target 8 changes to a distance d'. As a result, the shape of the focal spot of the X-rays 15 formed by the electron beam 10 is changed, causing a variation in image quality.

According to the present invention, if the container 11 is deformed as illustrated in FIG. 3B, the deformable member 14 interposed between the anode member 9 and the container 11 is deformed to absorb the deformation of the container 11. Although the deformation of the container 11 is transmitted to the retaining member 12 secured to the container 11, the retaining member 12 is merely in contact with the anode member 9 and the deformation of the container 11 is hardly transmitted to the anode member 9 even through the retaining member 12. This eliminates or reduces deformation of the anode member 9 caused by the deformation of the container 11, thus minimizing a variation in the distance d between the electron lens 6 and the target 8. For the deformation of the container 11 which may affect the anode member 9, a wall portion of the container 11 where the anode member 9 is attached may be deformed most significantly. According to the present invention, the deformable member 14 can absorb such deformation, thus eliminating or reducing the effect of the deformation on the anode member 9.

In the present invention, therefore, the anode member 9 does not have to be thick. The anode member 9 can have a thickness greater than or equal to 2 min and less than or equal to 3 mm in terms of designing an electron beam.

In the present invention, the deformable member 14 sandwiched, together with the anode member 9, between the container 11 and the retaining member 12 is a member that deforms to absorb stress from the container 11 or the retaining member 12. Although the deformation may be either plastic deformation or elastic deformation, elastic deformation can be used in terms of maintaining the hermeticity of the container 11. Specifically, if the container 11 deforms and then returns to its original form, the deformable member 14 may be able to deform in response to deformation of the container 11 and then return its original form.

To absorb the deformation of the container 11 in order to prevent deformation of the anode member 9, the deformable member 14 can be formed of a material having a lower Young's modulus than the container 11, the anode member 9, and the retaining member 12. In addition, allowing the deformable member 14 to have a lower Young's modulus than the container 11, the retaining member 12, and the anode member 9 enables the deformable member 14 to be in tight contact with the anode member 9, the retaining member 12, and the container 11. This achieves a high degree of hermeticity of the container 11. If the insulating fluid 17 is at a high pressure, the container 11 can maintain its form without leakage of the insulating fluid 17.

In the present invention, if the container 11 is deformed, the deformation will not affect the anode member 9 and the X-ray generating tube 1 including the anode member 9. Thus, the distance between the X-ray generating tube 1 and each inner part, other than the X-ray generating tube 1, accommodated in the container 11 will remain unchanged. Consequently, problems, such as dielectric breakdown of any inner part or the X-ray generating tube 1, are hardly likely to occur due to a variation in the distance between the inner part and the X-ray generating tube 1.

To satisfy the above-described relationship between the Young's moduli, the Young's modulus of the deformable member 14 is preferably greater than or equal to 0.001 GPa and less than or equal to 130 GPa, more preferably, greater than or equal to 0.001 GPa and less than or equal to 0.1 GPa. Examples of the material having a Young's modulus greater than or equal to 0.001 GPa and less than or equal to 130 GPa include metals, such as copper and aluminum, and elastomer having rubber elasticity. Examples of the material having a Young's modulus less than or equal to 0.1 GPa include nitrile rubber, silicone rubber, acrylic rubber, fluorocarbon rubber, and urethane rubber. In the present invention, nitrile rubber that is highly resistant to oil may be used.

To satisfy the above-described relationship between the Young's moduli, the container 11 may have a lower Young's modulus than the retaining member 12 and the anode member 9. Examples of the combinations of materials that satisfy the relationship between the Young's moduli include combinations 1 to 4 in Table 1. Note that a numeral under the name of each material denotes the Young's modulus of the material in Table 1.

TABLE 1

| | Deformable member 14 | Container 11 | Retaining member 12 | Anode member 9 |
|---|---|---|---|---|
| Combination 1 | Nitrile rubber <0.1 GPa | Aluminum 70 GPa | SUS 304 200 GPa | Kovar 159 GPa |
| Combination 2 | Nitrile rubber <0.1 GPa | Brass 103 GPa | SUS 304 200 GPa | Kovar 159 GPa |
| Combination 3 | Copper 130 GPa | SUS 304 200 GPa | Alloy of copper and tungsten 220 GPa | Tungsten 345 GPa |
| Combination 4 | Aluminum 70 GPa | Brass 103 GPa | SUS 304 200 GPa | Tungsten 345 GPa |

As illustrated in FIG. 3B, the deformation of the container 11 causes the retaining member 12 to be shifted relative to the anode member 9. As long as the deformable member 14 is an elastic member, the returning force of the deformable member 14 allows the anode member 9 to be pressed against the retaining member 12, thus maintaining the hermeticity of the container 11.

In the present invention, the distance, where the deformable member 14 is disposed, between the container 11 and the anode member 9 (or between the anode member 9 and the retaining member 12 in a modification, which will be described later) is preferably greater than or equal to 1 mm and less than or equal to 5 mm. The deformable member 14 may have any thickness that enables the hermeticity of the container 11 to be maintained and that is included in the above-described range of the distance.

The term "securing the retaining member 12 to the container 11" as used herein refers to connecting the retaining member 12 and the container 11 by using, for example, the screws 13 as illustrated in FIGS. 1 to 3B. The retaining member 12 may be connected to the container 11 by, for example, joining, welding, or adhesive, instead of the screws 13. In addition, as illustrated in FIG. 4E, the container 11 and the retaining member 12 may be threaded and the retaining member 12 may be screwed onto the container 11.

On the other hand, the anode member 9 is merely in contact with the adjacent members. Unlike the retaining member 12 secured to the container 11, the anode member 9 is not secured to the adjacent members. In the present invention, the anode member 9 is sandwiched together with the deformable member 14 between the retaining member 12 and the container 11 such that the anode member 9 interposed between the retaining member 12 and the container 11 is integrated with the retaining member 12 and the container 11.

FIGS. 4A to 4E illustrate connected states of the anode member 9 and the container 11 according to modifications of the embodiment of the present invention. In the above-described embodiment, the anode member 9 is in contact with the retaining member 12, and the deformable member 14 is disposed between the anode member 9 and the container 11. Referring to FIG. 4A, the anode member 9 is in contact with the container 11, and the deformable member 14 is disposed between the anode member 9 and the retaining member 12. In this modification, assuming that the deformable member 14 is formed of rubber having low thermal conductivity, heat generated from the target 8 can be easily transmitted through the anode member 9 to the insulating fluid 17 and the container 11, which dissipate heat more efficiently than the deformable member 14. This arrangement is excellent in heat dissipation.

Referring to FIG. 4B, an outer deformable member 14*o* is disposed in an outer clearance that is located outer than the anode member 9 and that is formed between the retaining member 12 and the container 11. An inner deformable member 14*i* is disposed in an inner clearance between the anode member 9 and the retaining member 12. This arrangement eliminates or reduces a likelihood that the hermeticity of the container 11 may be reduced upon deformation of the container 11.

FIG. 4C illustrates an arrangement in which a back deformable member 14*b* is disposed between the anode member 9 and the container 11 and a front deformable member 14*f* is disposed between the anode member 9 and the retaining member 12. The pair of deformable members 14*b* and 14*f* sandwich the anode member 9.

FIG. 4D illustrates an arrangement in which the retaining member 12 is disposed inside the container 11. In FIG. 4D, the container 11 has an opening for installing the X-ray generating tube 1 in addition to the opening 11*a*. After the X-ray generating tube 1 is installed through the opening, the opening is used to secure the retaining member 12 to the container 11. In this arrangement, the screws 13 are not exposed on the outside of the container 11. This arrangement improves the appearance of the X-ray generating apparatus 20 and eliminates a likelihood that the screws 13 may be removed accidentally.

Referring to FIG. 4E, the retaining member 12 and the container 11 each have a thread and they are engaged with each other. This arrangement allows uniform pressure application in the circumferential direction of the insulating tube 3, thus enhancing the hermeticity of the container 11. This arrangement can reduce the risk of leakage of the insulating fluid 17.

Radiography System

A radiography system according to an embodiment of the present invention will now be described with reference to FIG. 5, which schematically illustrates an exemplary configuration of the system.

A radiography system 50 according to the present embodiment of the present invention includes the X-ray generating apparatus 20 according to the present invention, an X-ray detecting apparatus 53, and a system controller 51. The system controller 51 controls the X-ray generating apparatus 20, which includes the X-ray generating tube 1 and the driving circuit 16, and the X-ray detecting apparatus 53 such that these apparatuses work in collaboration with each other. The driving circuit 16 outputs various control signals to the X-ray generating tube 1 under the control of the system controller 51. Radiation states of X-rays emitted from the X-ray generating apparatus 20 are controlled in response to the controls signals. The X-rays emitted from the X-ray generating apparatus 20 penetrate an object 56, and are then detected by an X-ray detector 54 included in the X-ray detecting apparatus 53. The X-ray detecting apparatus 53 converts the detected X-rays into an image signal and outputs the signal to a signal processor 55. Under the control of the system controller 51, the signal processor 55 subjects the image signal to predetermined signal processing. The signal processor 55 outputs the processed image signal to the system controller 51. The system controller 51 generates a display signal for displaying an image on a display 52 based on the processed image signal, and outputs the display signal to the display 52. The display 52 displays an image based on the display signal as a captured image of the object 56 on a screen.

According to the present invention, deformation of the container 11 of the X-ray generating apparatus 20 does not affect the anode member 9. This eliminates a likelihood that the position of the focal spot of X-rays to be detected by the X-ray detector 54 may be shifted due to deformation of the container 11 associated with driving of the X-ray generating apparatus 20. Thus, the radiography system 50 according to the embodiment of the present invention achieves highly accurate imaging without any shift of the position of the focal point of X-rays during imaging.

The radiography system according to the present invention can be used for nondestructive inspection of industrial products and diagnosis of diseases in humans and animals.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-133619, filed Jul. 2, 2015, which is hereby incorporated by reference herein in its entirety.

The invention claimed is:

1. An X-ray generating apparatus comprising:

an X-ray generating tube; and a container that accommodates the X-ray generating tube, the X-ray generating tube including an anode that includes a transmission target configured to generate X-rays and an anode member holding the transmission target, the anode member being sandwiched together with a deformable member between the container and a retaining member secured to the container, thus connecting the X-ray generating tube to the container.

2. The apparatus according to claim 1, wherein there is an overlapped portion in any at least three of the anode member, the deformable member, the retaining member, and the container in a radial direction of the X-ray generating tube.

3. The apparatus according to claim 1, wherein the deformable member is in contact with the anode member.

4. The apparatus according to claim 1, wherein the deformable member continuously extends in a circumferential direction of the X-ray generating tube.

5. The apparatus according to claim 1, wherein the deformable member deforms elastically or plastically.

6. The apparatus according to claim 1, wherein the deformable member has a lower Young's modulus than the container, the retaining member, and the anode member.

7. The apparatus according to claim 6, wherein the Young's modulus of the deformable member is greater than or equal to 0.001 GPa and less than or equal to 130 GPa.

8. The apparatus according to claim 7, wherein the Young's modulus of the deformable member is greater than or equal to 0.001 GPa and less than or equal to 0.1 GPa.

9. The apparatus according to claim 8, wherein the deformable member comprises nitrile rubber.

10. The apparatus according to claim 6, wherein the container has a lower Young's modulus than the retaining member and the anode member.

11. The apparatus according to claim 1, wherein an inside space of the container is filled with an insulating fluid.

12. A radiography system comprising:

the X-ray generating apparatus according to claim 1;

an X-ray detecting apparatus configured to detect X-rays emitted from the X-ray generating apparatus and penetrated through an object; and a system controller configured to control the X-ray generating apparatus and the X-ray detecting apparatus such that these apparatuses work in collaboration with each other.

* * * * *